United States Patent [19]

Simpson et al.

[11] 4,403,980

[45] Sep. 13, 1983

[54] PREFABRICATED WATERTIGHT STRUCTURAL SYSTEM

[75] Inventors: Harold G. Simpson, Oklahoma City; Michael L. Roberts, Norman, both of Okla.

[73] Assignee: Star Manufacturing Company of Oklahoma, Oklahoma City, Okla.

[21] Appl. No.: 624,587

[22] Filed: Oct. 22, 1975

Related U.S. Application Data

[63] Continuation-in-part of Ser. No. 336,364, Feb. 27, 1973, Pat. No. 4,078,351.

[51] Int. Cl.[3] ..... E04D 3/362; E04D 1/28

[52] U.S. Cl. ..... 52/309.11; 52/483; 52/592

[58] Field of Search ..... 428/315; 52/540, 520, 52/592, 615, 483, 309.1, 309.8, 309.9, 309.11, 309.13, 309.15, 409, 478, 90, 618, 543; 156/71

[56] References Cited

U.S. PATENT DOCUMENTS

| | | | |
|---|---|---|---|
| 985,140 | 2/1911 | Button | 52/540 |
| 2,209,816 | 7/1940 | Grapp | 52/619 |
| 2,234,621 | 3/1941 | Brous | 52/309.13 |
| 2,874,652 | 2/1959 | Wilson | 52/478 |
| 2,950,788 | 8/1960 | Edgar | 52/518 |
| 3,111,787 | 11/1963 | Chamberlain | 52/309.9 |
| 3,280,528 | 10/1966 | Dunlap | 52/309.8 |
| 3,367,076 | 2/1968 | O'Brien | 52/309 |
| 3,468,086 | 9/1969 | Warner | 52/173 |
| 3,557,507 | 1/1971 | Wilder | 52/404 |
| 3,672,951 | 6/1972 | Moore et al. | 428/321 |

*Primary Examiner*—John E. Murtagh

*Attorney, Agent, or Firm*—Hubbard, Thurman, Turner & Tucker

[57] ABSTRACT

A prefabricated panel system which can be erected to form a watertight surface such as the roof or walls of buildings is described. The panels are structurally sufficient to bridge between spaced support beams. Each panel includes a rectangular sheet metal support subpanel having corrugations extending between and bridging the support members. A surface panel assembly comprising a Hypalon membrane intimately bonded to a thin, flat metal sheet by an epoxy adhesive is mounted on the corrugated subpanel by a foamed insulating layer. The corrugated metal panel extends beyond the foam and the surface panel assembly to form a corrugated lip. Hypalon fastener halves are disposed along each edge of the Hypalon sheet on flexible flaps for extending over the joint between adjacent panels and mating with similar fastener halves along edges of adjacent panels to form a watertight mechanical interconnection between the Hypalon membrane on adjacent panels. The top sheet is connected to the corrugated panel along the edges of the panel which extend across the support members to apply a tension force from the opposite edges of the corrugated panel to the opposite edges of the top metal sheet while permitting free two-dimensional motion between the two metal sheets as a result of greater thermal activity of one sheet than the other. The edges of the lower metal sheet are rolled to provide additional strength and extend beyond the edges of the top metal sheet. A foam joint filler is positioned over one rolled edge, and a flexible foam sealing strip is placed along the top of the other rolled edge and across the corrugated lip to form a vapor barrier when the panels are installed. In the assembled system, a plurality of panels are placed in edge-to-edge relationship such that each panel bridges the support members. Self-tapping fasteners then penetrate the joint filler and overlapped rolled edges of adjacent panels to fasten the opposite edges of the panels to the support members. The fastener halves are engaged to provide a continuous waterproof membrane extending across the joint between adjacent panels. Finally the joints at the intersection of four corners, which has a special configuration resulting from the relationship between the ends of mating fastener halves, are sealed to complete the waterproof membrane.

2 Claims, 13 Drawing Figures

PREFABRICATED WATERTIGHT STRUCTURAL SYSTEM

This is a continuation-in-part of my co-pending application Ser. No. 336,364, filed Feb. 27, 1973, entitled "Construction System", and assigned to the assignee of the present invention now U.S. Pat. No. 4,078,351.

This invention relates generally to prefabricated structural systems and more specifically relates to a structural system particularly suited for roofs of buildings, or other exterior or interior walls requiring a continuous fluid-tight membrane with superior structural strength, and good insulating and fire resistant properties adequate to meet building codes.

Conventional built-up roofing systems have been employed for many years. In this method of construction, a horizontal roof deck, typically currugated deck and insulation, planking or plywood, is supported on underlying structural beams. The entire roof deck is covered by a continuous weatherproof membrane usually comprising alternate layers of felt and bitumen to prevent penetration of moisture into the building interior. The membrane is applied in a field operation by application of alternate layers of hot or cold bitumen and felt. Once the membrane is applied to the desired thickness, gravel, rock or similar aggregate material is spread upon the roof to provide ballast to hold the roof down against wind generated uplift and protection against weathering. To reduce heat transfer through the roof deck, insulation is often applied to the underside of the roof deck at the interior of the building. Insulation may also be applied on the exterior of the roof deck and subsequently covered with the water resistant membrane and ballast rock.

There are many difficulties with built-up roof systems of the type described above. Since the construction of the built-up roof is entirely a field operation, there is little uniformity of quality from one building to another and consequently the integrity of such a roof structure varies considerably. A built-up roof membrane has a tendency to bubble and crack. This deterioration results from a number of factors including expansion and contraction from severe temperature changes, moisture trapped below the water resistant membrane, and improper construction techniques. Further, built-up roofs do not readily withstand heavy foot traffic and are susceptible to damage from traffic. Also considerable safety and environmental hazards exist in the application of hot tar which often gives off toxic fumes and polluting matter. Because of the undesirable nature of the hot tar process, local and federal safety and pollution standards often prohibit or restrict the use of built-up systems which formerly had wide acceptance.

In co-pending U.S. applications Ser. No. 336,370, filed Feb. 27, 1973, now U.S. Pat. No. 3,909,998, and U.S. Ser. No. 336,364, filed Feb. 7, 1973, both of which are assigned to the assignee of the present invention, both disclosures of which are hereby incorporated in this application by reference, a prefabricated panelized roofing system is described and claimed which employs Hypalon membrane panels having superior weathering characteristics as a top surface on prefabricated panels capable of spanning spaced substructural members. These panels include extruded Hypalon fasteners along the edges of the Hypalon membranes which can be engaged after the panels are arrayed in a roof structure and fastened to the underlying structure to form a continuous watertight membrane when the intersection of four sides is properly sealed. In order for such a system to be commercially successful, various governmental building code requirements, Underwriters Laboratory ratings, and manufacturers association ratings must be met. The panels ability to withstand catastropic failure due to wind uplift, general load bearing ratings, fire ratings for both resisting and containing an interior fire, and for resisting flying embers from adjacent burning buildings. In addition, the panels must have a good U-factor, i.e., insulation rating. Because one face of each panel is exposed to the interior of a building, with a relatively stable temperature, while the other surface is an exterior surface of the building, the panel must be able to withstand relatively large, highly cyclical thermal stresses. In addition, such panels must be economical and repeatedly manufacturable on a production line and must require minimum field erection labor and skill. Such a system must also be erectable in adverse temperature and moisture conditions.

The present invention is concerned with a panel system which has high strength but light weight so that it can be manually lifted, superior weathering qualities, is reliably fluid-tight, is easily and quickly erected in a wide variety of weather conditions with minimum labor and skill, which provides a strong and convenient platform for workmen during all stages of erection, which has good resistance to fire resulting from flying embers on the top surface, which has superior insulating properties, which can withstand extreme temperature cycling, which has a relatively high rating for containing interior fire, and which can be relatively economically manufactured with a minimum capital investment and minimum transportation cost. The panel also serves as a stable, flat base for accessories and penetrations, and is highly resistant to handling and erection damage. The invention is also concerned with method of fabricating and erecting the panel system, including such a method which can be carried out at various locations so as to minimize capital investment and transportation costs.

In accordance with the invention, a prefabricated panel comprised of a Hypalon membrane intimately bonded to a metal sheet by an epoxy adhesive which unique combination provides a surface which has superior weathering characteristics and is highly resistant to most corrosive agents in that the epoxy adhesive blocks penetration of corrosive vapors through pin holes in the Hypalon, is watertight, and is resistant to burning embers. The combination is resistant to penetration by sharp objects, resists wear and deformation due to heavy foot traffic, and provides high tensile strength to resist wind uploads when the edges of the panel are fastened to a supporting structure by reason of continuous metal systems extending across the top of the panel. Extruded Hypalon fasteners bonded along the edges of the Hypalon membrane with a flexible web and extending over the edges of the panel which are fastened to the supporting structure provide a continuous waterproof membrane across adjacent panels. The sheet metal provides a good heat sink for quickly transmitting heat away from burning embers so that the Hypalon membrane does not reach combustion temperature. An insulating layer is provided below the sheet metal for providing insulation where required. The insulating layer may also provide beam strength when bonded to an underlying corrugated subpanel or other structural member providing the strength to span spaced supporting beams. The corrugated subpanel preferably has rolled opposite edges for increased load bearing strength, where strength is most needed, and the rolled edges project beyond the edges of the top sheet panel so that self-tapping fasteners may be used to connect the edges of the corrugated panels to the supporting beams. The edges of the corrugated panel are also fastened to the top sheet metal panel by a plurality of tightly engaged staple fasteners disposed along the sides of the panel. These staples prevent delamination of the sandwich structure and transmit tension from the upper panel through self-tapping fasteners passing through the rolled edges to the supporting beam structure when the panel is subjected to wind uplift loads. In the latter case, the self-penetration fasteners are driven through the rolled edges of two adjacent corrugated subpanels to fasten the panels to the transversely extending structural member and thus connect the upper panel to the underlying structural member via the staple fasteners to form a series of tension straps as described and claimed in the above referenced patent. The bottom surface of the corrugated sheet may be coated with a sublimating material which sublimates at a temperature below that at which the foam insulating material is damaged in order to improve the fire ration of the panel. The invention is also concerned with a method for fabricating the panel system and its components. The above features of the invention are set forth in various combinations and subcombinations such as have distinct and separate utility in the appended claims.

The novel features believed characteristic of this invention are set forth in the appended claims. The invention itself, however, as well as other objects and advantages thereof, may best be understood by reference to the following detailed description of illustrative embodiments, when read in conjunction with the accompanying drawings, wherein:

Figure 1:
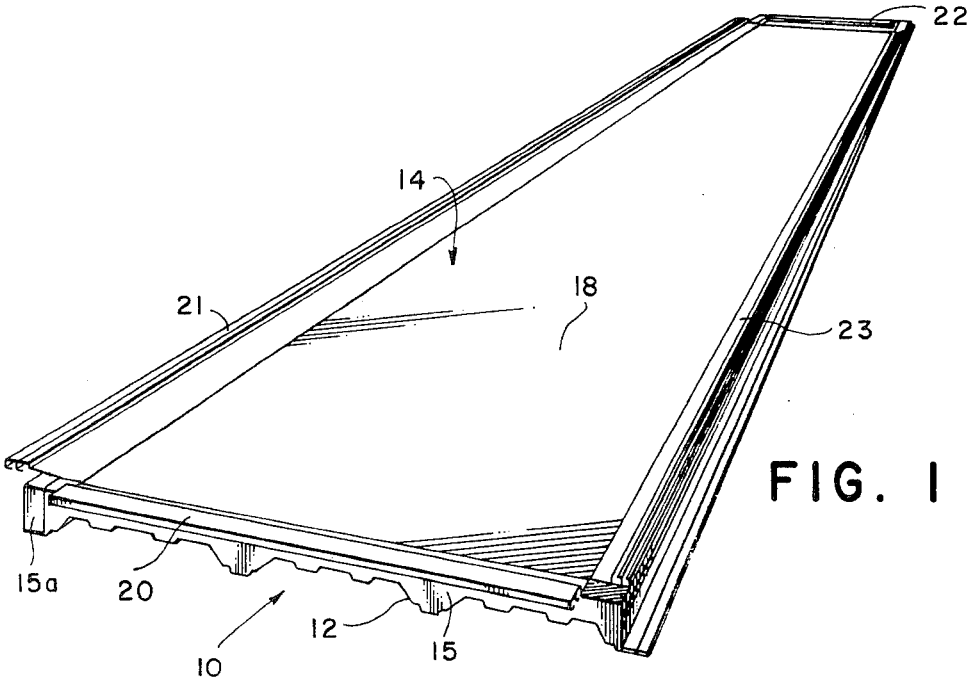
FIG. 1 is a perspective view from one end of a panel in accordance with the present invention.

Referring now to the drawings, a panel in accordance with the present invention is indicated generally by the reference numeral 10 in FIG. 1. The panel 10 is typically about three feet wide and from twenty to forty feet in length. The panel as illustrated in FIG. 1 can be completely prefabricated at one or more assembly line type factories prior to transportation to an erection site. The panel is designed to require minimum field labor for erection and yet to produce a reliable watertight roof, ceiling or wall system, either interior or exterior, where a fluid-tight membrane is required. As can best be seen in FIG. 2, the panel 10 includes a corrugated sheet metal subpanel 12 which provides structural strength for spanning between two spaced structural beams, commonly Z-shaped purlins or bar jets, a top subpanel assembly 14, and a foam insulating layer 16 sandwiched between the subpanels 12 and 14 as a result of being foamed in place.

As can best be seen in FIG. 14, the subpanel assembly 14 is comprised of a Hypalon membrane intimately bonded to a flat sheet metal member 16 over substantially its entire surface by an epoxy or other suitable adhesive. As used in the present specification and claims, the term Hypalon means the class of synthetic materials marketed by DuPont Chemical Company under that trademark and such other synthetic materials which have similar physical properties and which are therefore substantially functional equivalent with the "doctrine of equivalence" established in the United States law. The Hypalon membrane 18 is a thin colandered sheet of synthetic material having exceptional corrosion resistance and weathering properties when exposed to sun, heat, cold, moisture, chemicals and atmospheric pollutants. However, colandered material, particularly thin sheets, often does ot provide a watertight surface because of small pin holes and other slight imperfections. Also, the Hypalon material does not have exceptional mechanical strength and tends to be subject to creeping when placed under external loads until such time as it has been fully cured by the passage of considerable time. Alternatively, the steel sheet 16 may have very poor weathering characteristics as a result of oxidation or rusting, because an important advantage of this invention is that non-galvanized or otherwise untreated steel may be used. However, the sheet steel has high tensile strength and sufficient stiffness to prevent deformation, particularly when backed by the foam insulation or a nearly solid deck and prevents puncture of the membrane. The Hypalon sheet 18 is intimately laminated with sheet metal 16 by means of a suitable epoxy adhesive. The epoxy adhesive provides good adhesive strength and also good weather and corrosion resistance, but otherwise be subject to mechanical abrasion and chipping. As a result of the combination of the metal sheet 16, the Hypalon layer 14 and the epoxy adhesive, an unusually appropriate surface is provided. The metal provides tensile strength for securing the unit in place when connected at its edges to support structure, and the dent resistance required to handle foot traffic and resist hail damage. The metal also supports the Hypalon against penetration by sharp objects and foot traffic such as might cause leaks. The Hypalon protects the sheet steel from corrosion. The epoxy seals any small pin holes or imperfections in the Hypalon layer 14, thus permitting the Hypalon to be made considerably thinner than customary, which, in turn, reduces its cost and improves the panels resistance to burning embers, as will presently be described. The epoxy seals any pin holes which result from making the Hypalon thinner, yet the Hypalon provides adequate protection to prevent mechanical damage to the underlying epoxy so that the epoxy provides additional corrosion protection against corrosive fluids which might penetrate the Hypalon. Perhaps more significant than any other factor is that the underlying sheet steel 16 provides a heat sink in intimate contact with the Hypalon layer 14 which rapidly conducts localized heat away from the Hypalon layer 14, thus preventing the Hypalon from reaching combustion temperature when exposed to burning embers. This enables the roofing system to pass fire tests which could not otherwise be passed due to flammability of the Hypalon. The method of fabrication of the subpanel assembly 14 and various uses of the subpanel assembly will hereafter be described in greater detail.

Extruded Hypalon fasteners 20–23 are positioned along the four edges of the panel 10 and thermally welded to the Hypalon membrane as generally illustrated in FIG. 1. As can best be seen in FIG. 4, the fastener half 21 has tongue and groove portion 21*a* of the general type described in co-pending U.S. patent application Ser. No. 445,498, filed Feb. 25, 1974, entitled "Cleaning Fasteners", and assigned to the assignee of the present invention, which is hereby incorporated by reference, including a web portion 21*b*. The web portion 21*b* is thermally bonded, i.e., vulcanized, to the Hypalon sheet 18 along its entire length generally in the transverse area designated by the brackets 21*c*. It will be noted that the grooves 21*a* face downwardly. Fastener means 23 along the opposite edge of the panel similarly has a groove portion 23*a* which faces upwardly, and a web portion 23*b* which is thermally bonded to the Hypalon sheet 18 as previously described. The fastener halves 29 and 22 are identical to the fastener halves 21 and 23 and have webs bonded to the Hypalon membrane 14 in the same manner.

Figure 2:
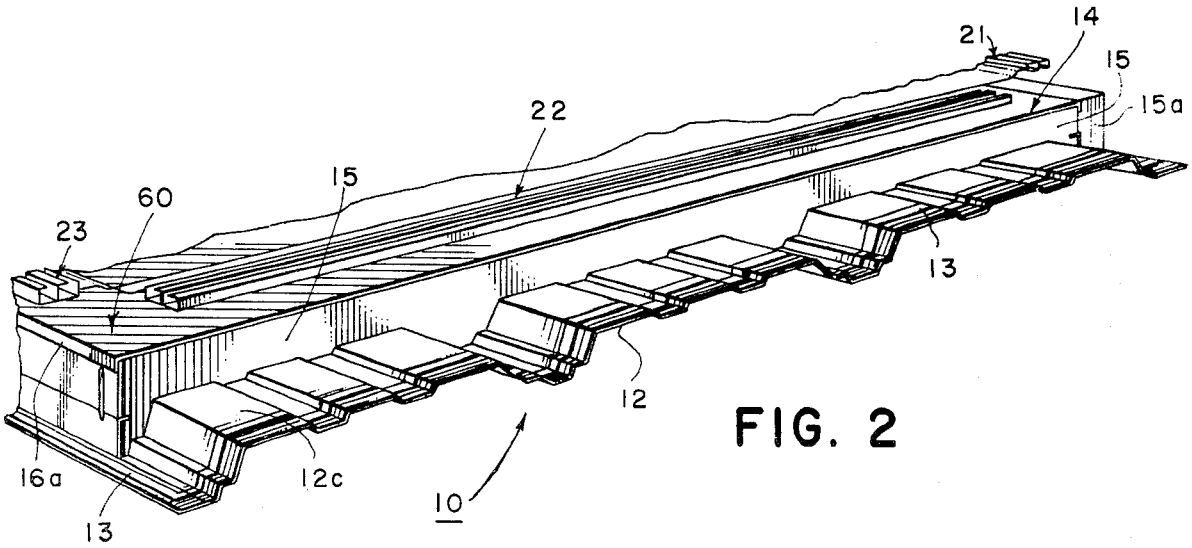
FIG. 2 is an enlarged perspective view of the opposite end of the panel of FIG. 1.
Figure 3:
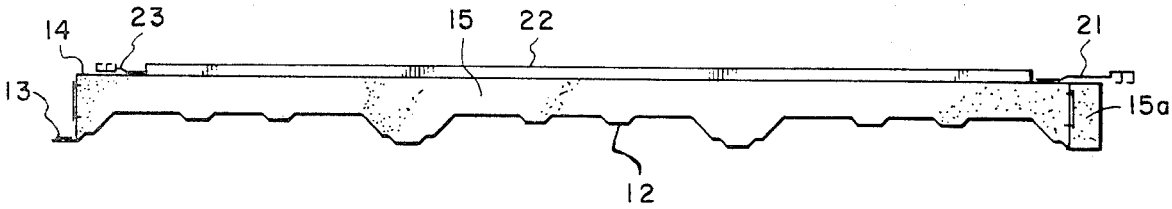
FIG. 3 is an elevational view of the end of the panel shown in FIG. 2.
Figure 5:
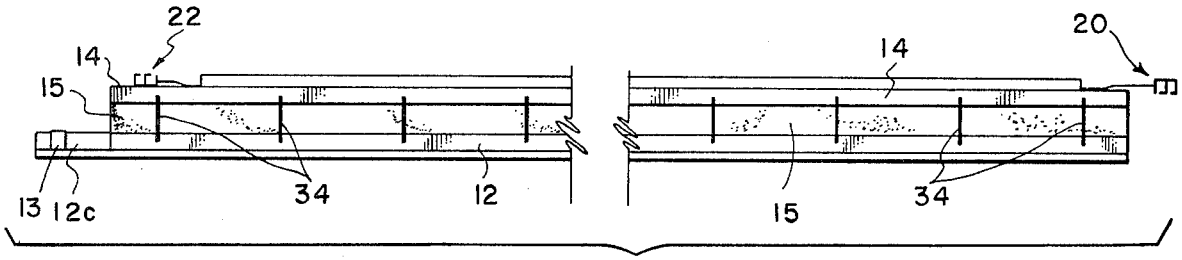
FIG. 5 is a fragmented side elevational view of the panel of FIG. 1 with the center portion omitted.
Figure 6:
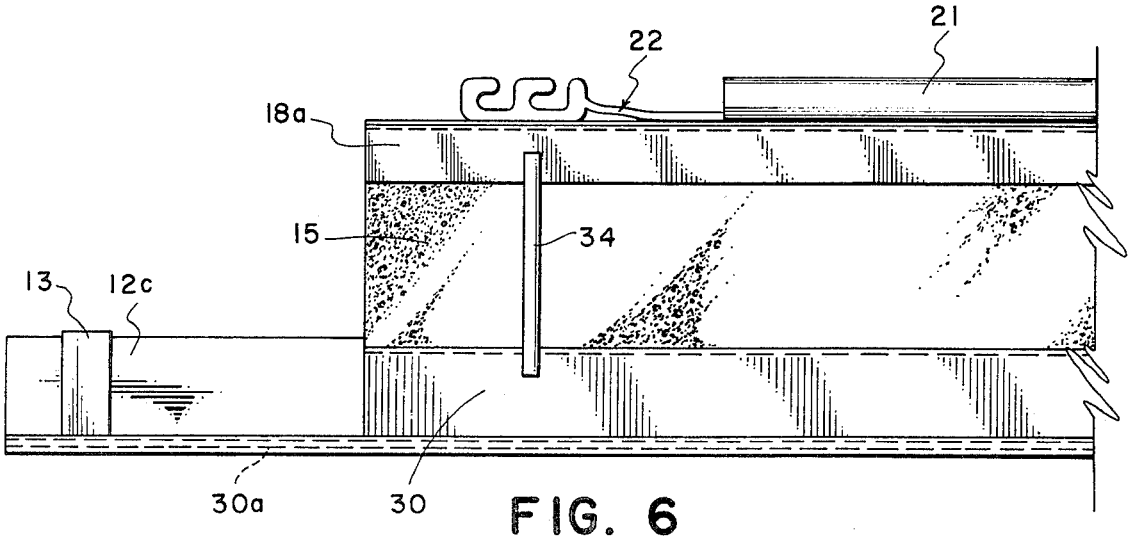
FIG. 6 is an enlarged side elevational view of one end of the panel of FIG. 1.

As can best be seen in FIGS. 2 and 5, the sheet metal subpanel 12 extends beyond one end of the subpanel assembly 14 to provide a lip 12*c*. The other end of the subpanel 12 terminates at the same point as the subpanel assembly 14. On the other hand, it will be noted that the ends of the foam insulating layer 16 are aligned with the end of the subpanel assembly 14 at both ends.

Figure 12:
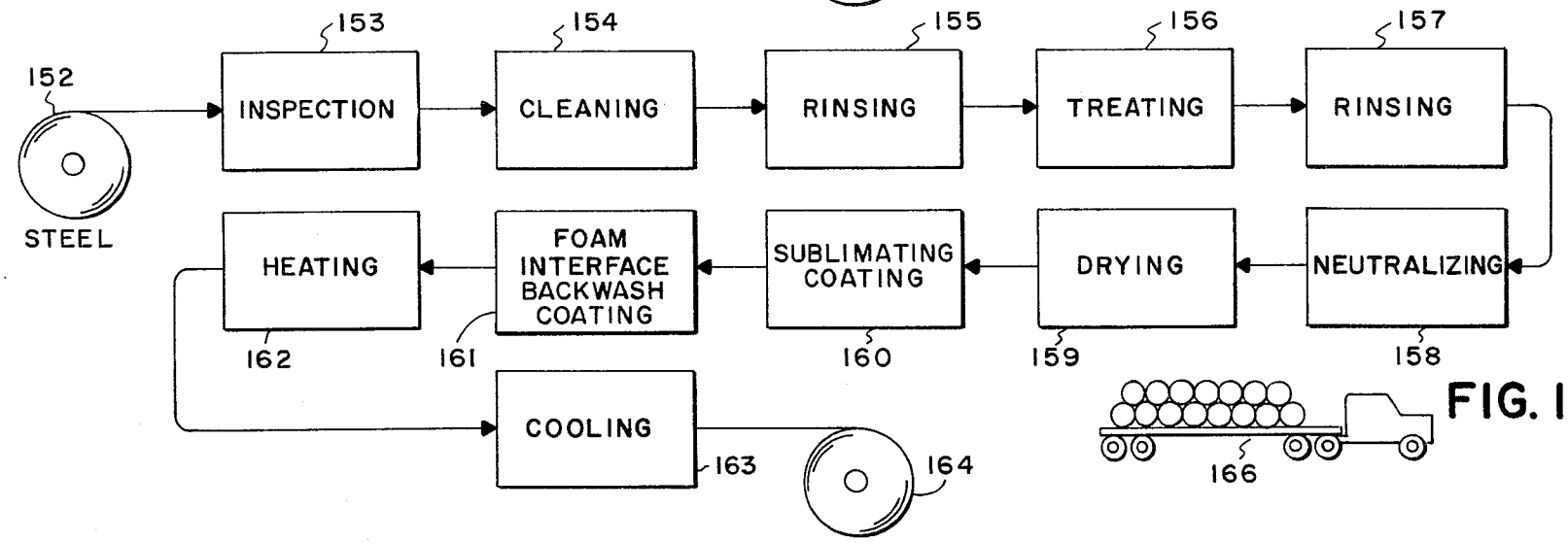

The metal sheet 16 of the subpanel assembly 14 has down turned side edges which form flanges 16*a* and 16*b*. Inserts 30 and 32 have identical Z-shaped cross sectional configurations and have lower flanges secured to the panel 12 by rolled lips 12*a* and 12*b* of the panel 12. If desired, the Z-shaped members 30 and 32 may be formed as a continuation of the panel 12. However, for reasons as will hereafter be set forth in greater detail, the structure of FIG. 12 is preferred because of the additional strength provided by the additional layer of metal resulting from clasping the lower flanges 30*a* and 32*a* of Z-members 30 and 32 in the rolled edges of the lower panel.

A closed cell foam sealing strip 13 is attached to the top surface of the lip 12*c* and along the top of rolled edge 12*b* by a pressure sensitive adhesive to provide a vapor barrier near the interior surface of the roof assembly when the panels are installed, and thus prevent condensation between the panel edges when the exterior surface is cooler than the interior surface. The Hypalon membrane serves as a vapor barrier when the temperature differential is reversed.

The upper flanges 30*b* and 32*b* are in-turned and imbedded in the foam material 15 as a result of molding of the insulating material in place between the metal sheets. A plurality of staples 34 are driven through the flanges 16*a* and 16*b* and the web portions of the Z-members 30 and 32, respectively, at intervals of six inches, for example, along the length of the panel to securely fasten the metal sheet 16 to the Z-members 30 and 32. The staples 34 have barbs 34*a* which prevent the staples from woring out of the holes made in the sheet metal as a result of vibrations or due to wind when placed in service. In order to assure that the staples 34 transmit tension forces from the assembly 14 to the Z-members 30 and 32, thence to the subpanel 12, and finally to the underlying support structure as will presently be described, it is preferable to place the edges of the panel slightly under compression to compress the foam material 15 at the time the staples 34 are inserted by a conventional staple gun. When released, the sponge-like insulating material 15 then returns the panels toward the precompressed position to ensure that each of the staples 34 is in tension, or will quickly be placed in tension by any slight upward movement of the top surface of the panel due to wind loads or any other force tending to delaminate the sandwiched panel structure.

Figure 4:
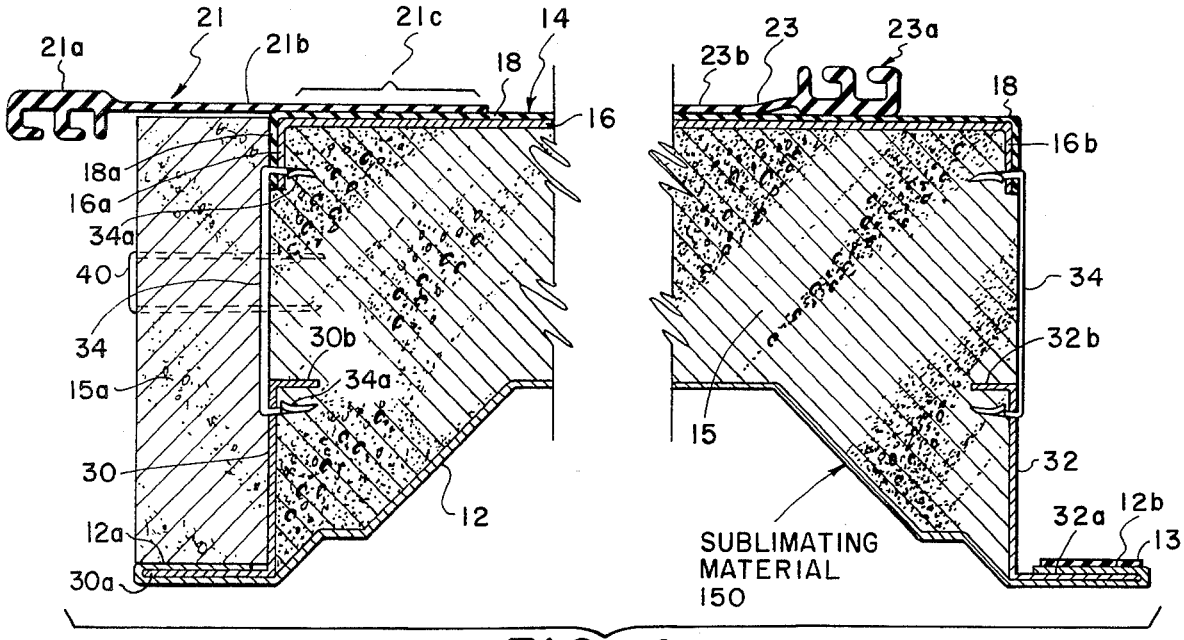
FIG. 4 is a fragmented transverse sectional view of the panel of FIG. 1 the center portion of the panel omitted.

A filler or insert 15*a* formed of the same or similar foam material as the foam layer 15 overlies the rolled edge 12*a* of the subpanel 12 as best seen in FIG. 4 in order to fill the space between adjacent panels when installed as will hereafter be described in connection with FIGS. 8 and 9. The insert 15*a* is installed at the prefabrication site in the position illustrated in FIG. 4 and secured in place by any suitable manner, such as by a plurality of conventional staples 40. It will be appreciated that the staples 40 serve only to hold the filler strips 15*a* in position until erection.

Figure 13:
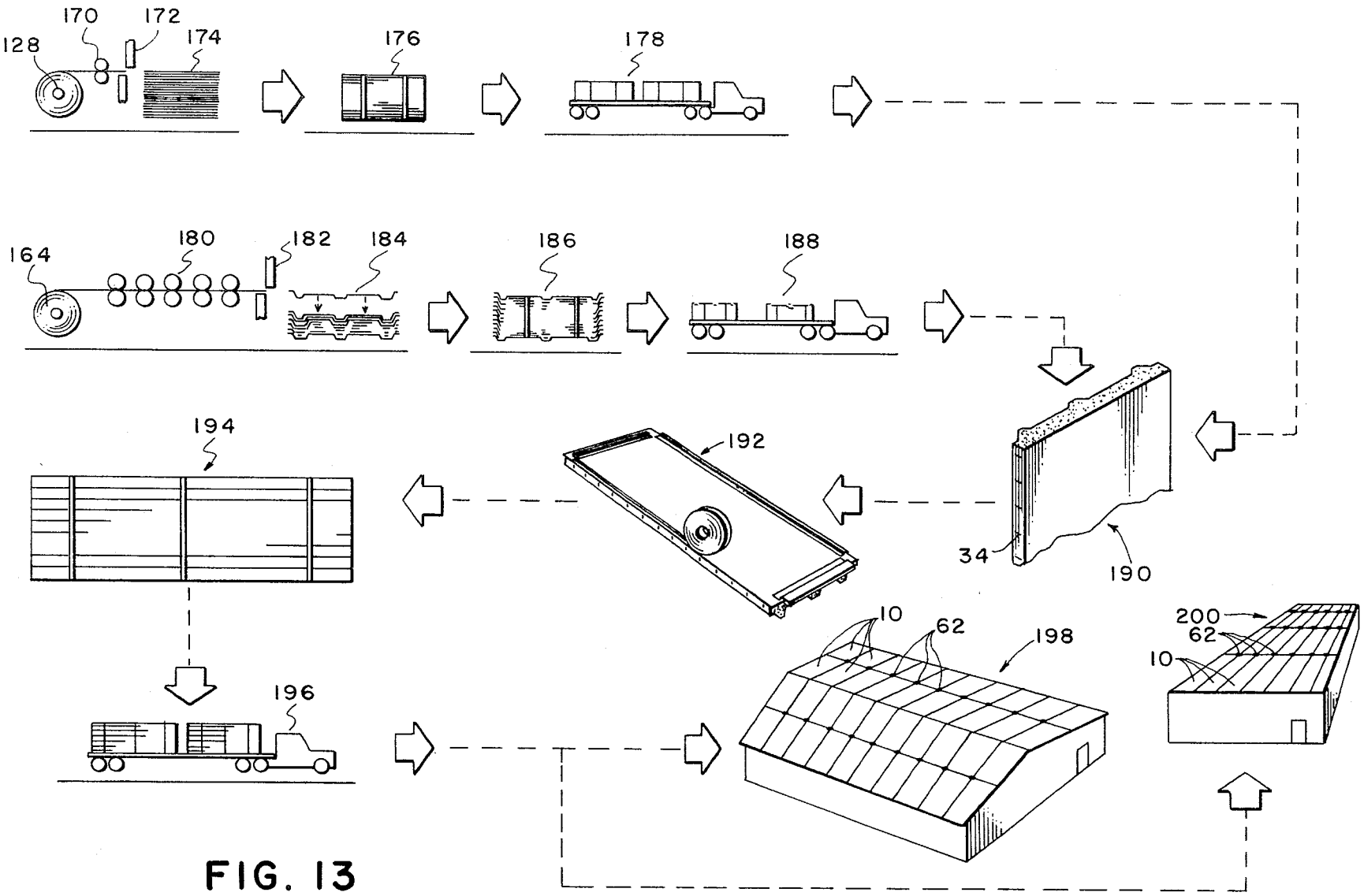
FIG. 13 is a schematic flow diagram illustrating further fabrication and assembly of the subcomponents produced by the methods illustrated in FIGS. 11 and 12 to produce building structures in accordance with the present invention.

The panels 10 are erected as illustrated in FIGS. 7–10 to provide a building structure such as illustrated in FIG. 13. As can best be seen in FIG. 10, the panels 10 are positioned tranversely across parallel structural beams commonly referred to as Z-shaped purlins 50 of a substructure adapted to support the load of the panel system together with wind, water and snow loads in the conventional manner. This substructure may be of any design so long as the structure provides support extending tranversely of the panels at longitudinally spaced intervals or, of course, continuously. As illustrated, the extension 12*c* of the panel 10*a* is positioned over a purlin. The flat end of the panel 10*b* is then nested in the corrugated extension 12*c* so that the fastener half 20 of panel 10*b* can be mated with the fastener half 22 of panel 10*a*. A plurality of purlins are normally disposed at intervals of four to eight feet along the length of the panel 10*b*. The extension 12*c* of panel 10*b* is also shown as being positioned over a purlin 50, although such positioning is not essential. A third panel 10*c* is nested on the extension 12*c* of panel 10*b* so that the corresponding fastener halves 20 and 22 may be mated.

Figure 7:
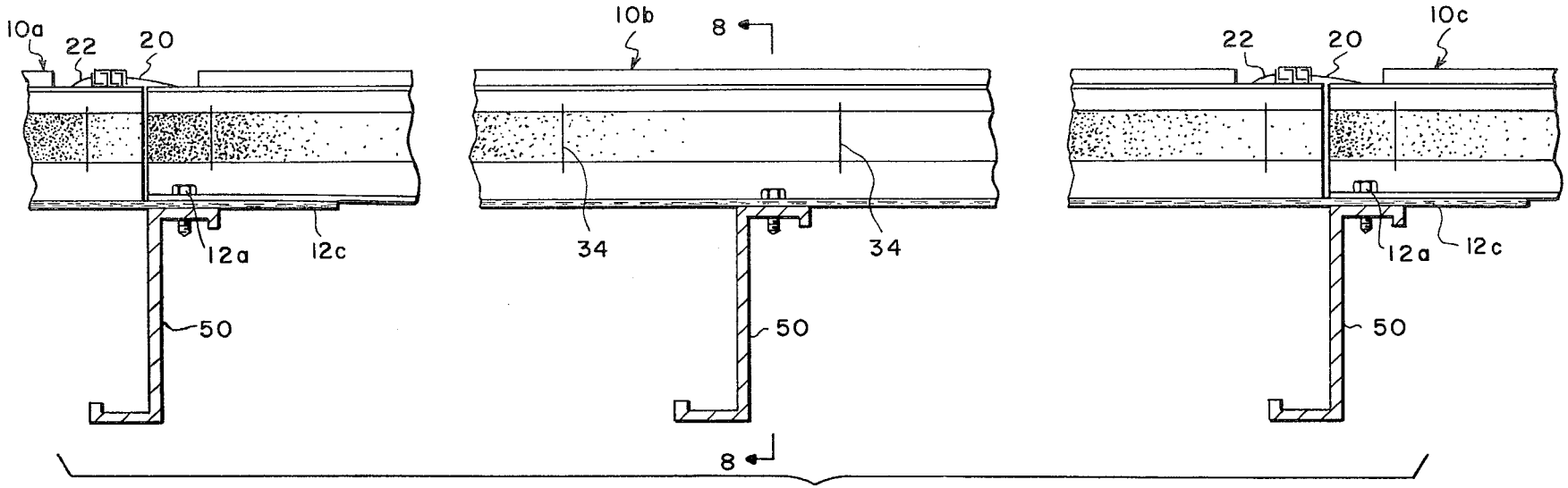
FIG. 7 is a side view of portions of a plurality of panels interconnected in end-to-end relationship and bridging across transversely extending substructural beams to form an assembled structure in accordance with the present invention, the mid portion of the center panel being omitted.
Figure 8:
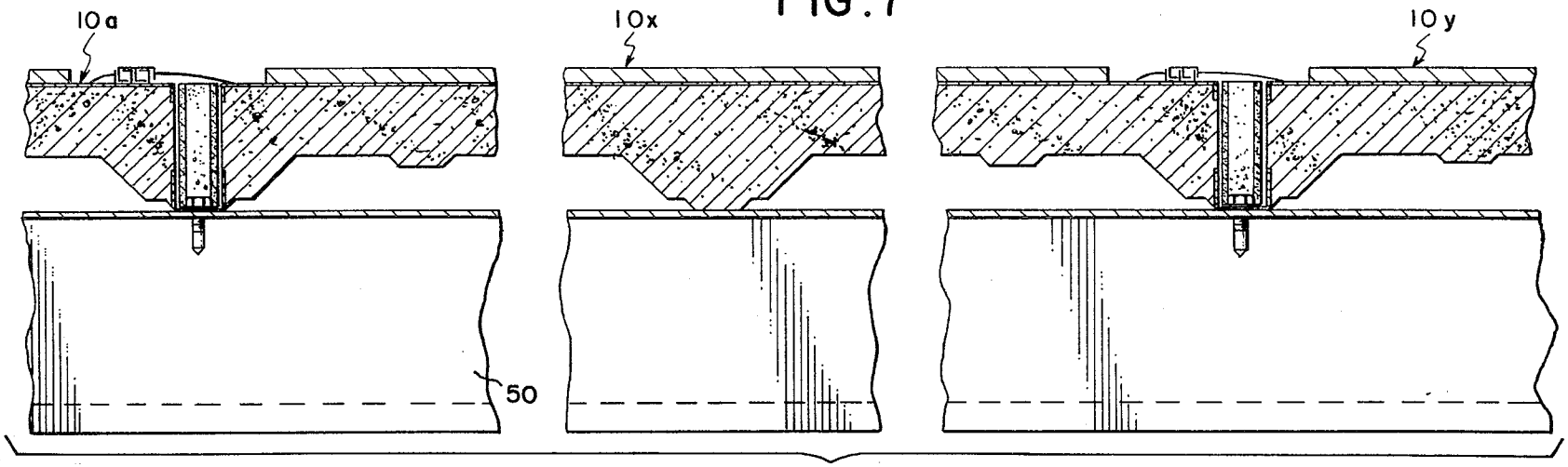
FIG. 8 is a sectional view extending transversely of the panels showing a plurality of panels interconnected as illustrated in FIG. 7.

After one or more of the panels 10*a*–10*c* are layed end-to-end as illustrated in FIG. 7, panels 10*x* and 10*y* may then be placed side by side with the panel 10*a* as illustrated in FIG. 8. As will be noted in FIG. 9, the rolled edge 12*a* of panel 10*x* overlies the rolled edge 12*b* of panel 10*a*. Before the respective fastener halves 21 and 23 are mated, a self-tapping hex head screw 52 is driven down through the foam filler strip 15*a* and passed through the overlapped roller edges 12*a* and 12*b*, including, of course, the lower flanges 30*a* and 32*a* and the Z-members 30 and 32*c* and finally is passed through and tapped into the flange of the purlin 50. This can be accomplished by merely manually pressing the self-tapping fastener 52 into the top of the foam strip 15*a* and then driving the self-tapping screw down through the foam material 15*a* to its final position as illustrated with a conventional powered nut driver at the end of a sufficiently long shank. This results in a bore 15*b* through the filler strip 15*a* which normally remains filled with loose foam particles. This procedure is repeated at both edges of each panel at each of the purlins 50. As the rolled edges of one panel is placed over the rolled edge of the other, the foam sealing strip, exposed by removing a wax paper protector, then forms a vapor seal between the adjacent corrugated panels to prevent entry of vapor into the joint where it might condense and cause severe problems.

As a result, a continuous tension strap is provided from the purlin 50 through the Z-members 30 and 32 and the respective staples 34 to the opposite edges of the top sheet metal panel 16, thus providing a generally continuous tension member across the top of the panel. The structural effect of the series of staples 34 is to provide the same effect as a continuous metal sheet or strap extending from the top subpanel 16 to the underlying structure member 50 to prevent delamination of the panels as a result of uploads from wind lift. Also of great importance is the fact that the staples 34 permit a universal or free floating movement between the top metal sheet 16 and the lower metal subpanel 12 as a result of greater thermal expansion and contraction of one sheet than the other. It will be appreciated that in an insulating panel such as illustrated, one of the panels is normally maintained at a relatively constant temperature while the other panel is subjected to wide variations in temperature, thus creating severe structural stresses in such a panel. The inclusion of the foam material 15 provides a sufficiently resilient material to permit expansion and contraction of one of the sheets relative to the other without suffering delamination between the foam material and the panels, when the panels are not otherwise constrained in movement by rigid mechanical interconnections. In this regard, it will be appreciated that as the insulation requirements increase, such as in cold storage buildings, the thickness of the foam material 15 is increased, the temperature differential between the interior and exterior of the panel increases, and the delamination problem proportionately changes.

Figure 9:
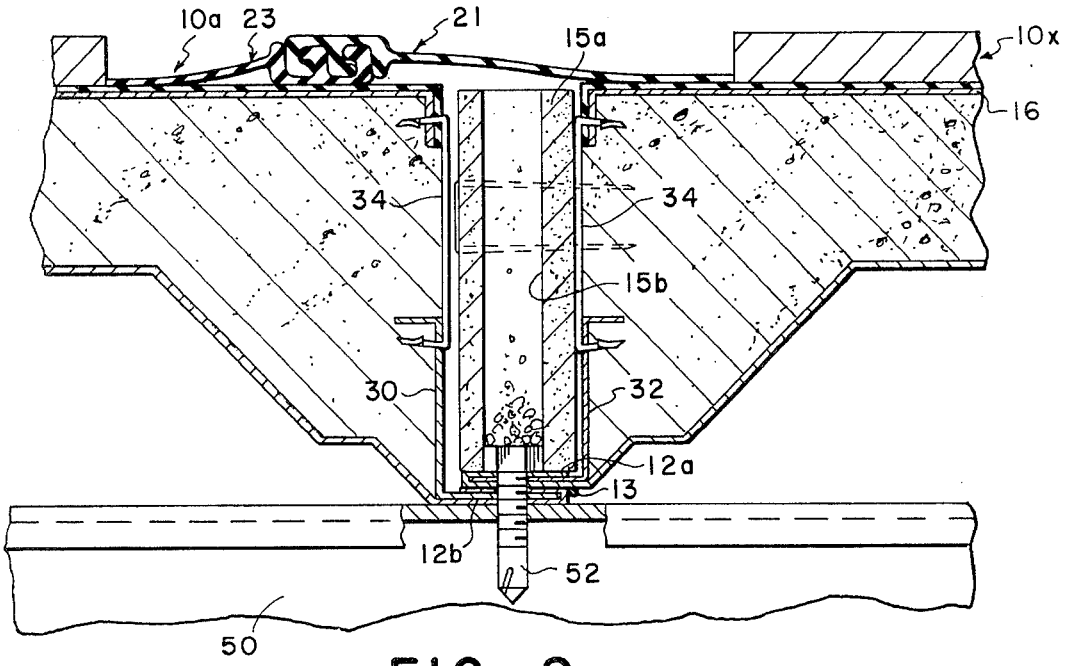
FIG. 9 is a cross sectional view illustrating the joint between two adjacent panels and the manner in which the panels are fastened to a structural member of a substructure.
Figure 10:
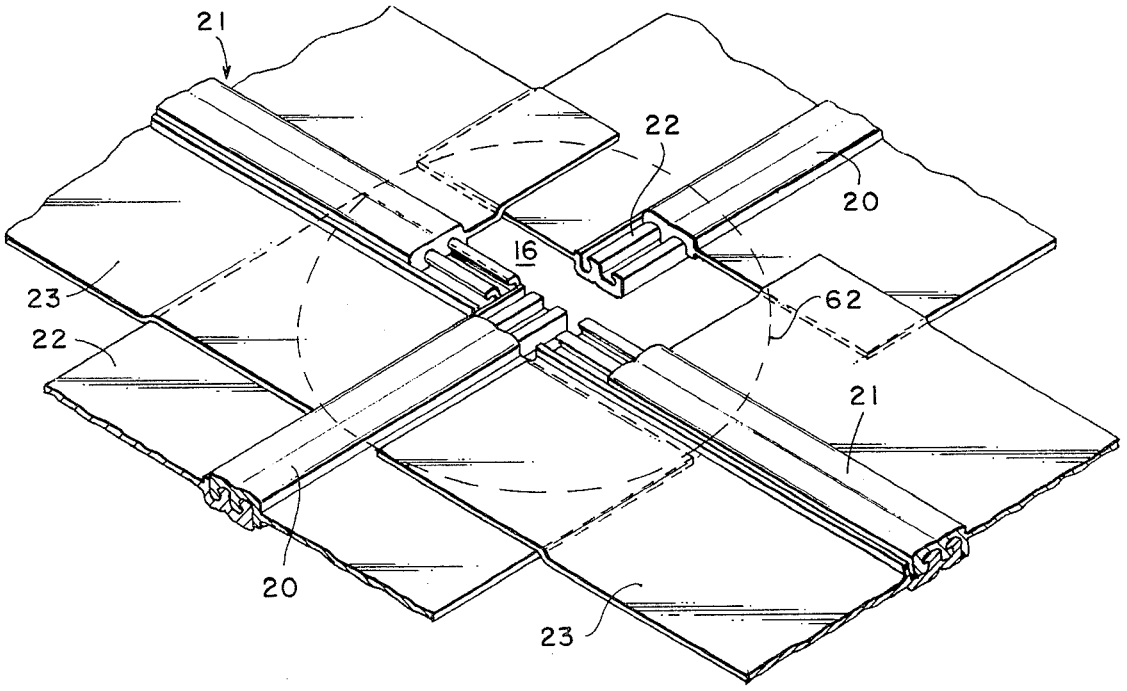
FIG. 10 illustrates the configuration of the lateral strip fastener halves at the common corners of four adjacent panels of the system of FIGS. 7, 8 and 9.

After the edges of all of the panels are fastened to the underlying purlins 50, as illustrated in FIG. 9, the fastener halves 20–23 can be mated along all adjacent edges on all panels. This results in a continuous fluid-tight membrane except for the corner joints such as illustrated in FIG. 10. It will be noted that the upwardly facing fastener halves 22 and 23 extend beyond the downwardly facing fastener halves 20 and 21. It will also be appreciated that the opening overlies the corner 60 of the panel as illustrated in FIG. 2 which is covered with the Hypalon membrane 16. This opening is then sealed by means of a Hypalon putty material formed by dissolving Hypalon in a suitable solvent, such as toluene, which upon evaporation leaves a solid mass of Hypalon material bonded to the fastener halves and to the exposed surface of the membrane 16. This solvent is placed in a solid mass approximately ¼ to ⅜ inch deep and within the area bounded by the dotted outline 62 in FIG. 10, although the actual putty material is not illustrated in order to reveal the arrangement of the fastener halves. The solvent in the dissolved material also dissolves the surface of the Hypalon fasteners as well as the Hypalon membrane 16 to provide an intimate bond. The resulting mass of Hypalon is subsequently fixed by the radiation from the sun and finally by the passage of time to provide an integral chemical seal for the corner joint. It is important to note that the ends of the joint between the downwardly facing fastener halves and the upwardly facing fastener halves is exposed to ready access to the dissolved Hypalon material so that the ends of the capillaries extending along the length of the fastener grooves are sealed. Also, all other paths leading along the surfaces of the various overlapped layers of Hypalon materials are similarly sealed. Alternatively, a mechanical device can be used to compress a mastic on to the area defined by the dotted line 62 seal the capillaries and form a peripheral surface dam in substantially the same manner.

Figure 11:
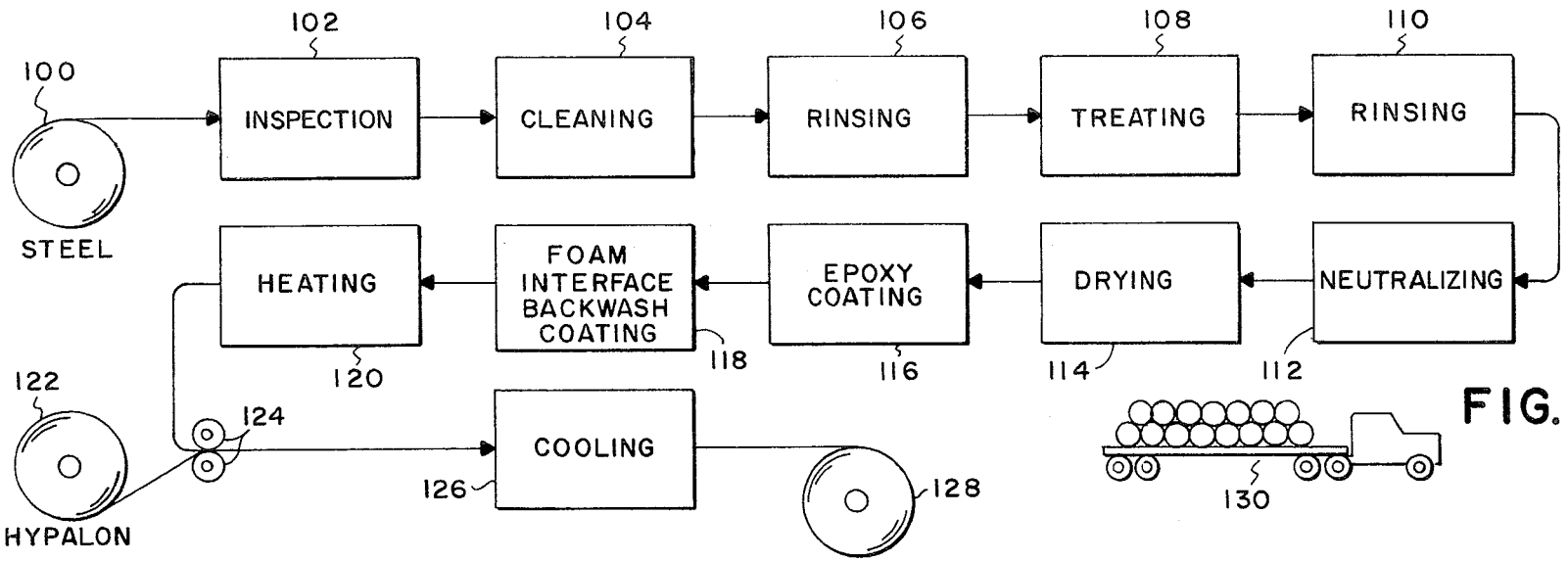
FIGS. 11 and 12 are schematic flow diagrams illustrating the fabrication of subcomponents of the present invention.

A preferred method for fabricating the panels of FIG. 1 in accordance with the present invention is illustrated in FIGS. 11–13. A coil sheet steel of the appropriate width to form the sheet 18 of the panel assembly 14 is passed through a conventional coil laminating system at a coil laminating plant as illustrated in FIG. 11. The steel passes from a coil 100 to an inspection station 102 to a cleaning station 104 where the steel is cleaned with suitable liquid. These liquids are then rinsed at a station 106 followed by an additional cleaning station 108, rinsing station 110 and neutralizing station 112. Finally the steel web is dried at station 114 prior to passing through an epoxy coating station 116. A layer of epoxy is then applied to the one surface of the web which is then back coated at station 118 with a foam interface liquid generally in the form of a paint. The epoxy adhesive is preferably the two component type which is premixed prior to application to form a long lasting, significantly corrosive-resistant coating, and specifically be of the type marketed by B. F. Goodrich as epoxy system No. HB2005. The web then passes through a heating station 120 to cure the backwash coating and prepare the epoxy for receiving the Hypalon membrane 18 from a roll 122. The Hypalon membrane from the roll 122 together with the sheet steel from roll 100 are then passed between a pair of rollers 124 to firmly compress the Hypalon and sheet steel web against the epoxy coating. This forces the epoxy into any pin holes in the Hypalon and assures a close intimate bond between the two materials. The web is then coated at station 126 and finally rewound as a roll 128. The rolls 128 are then transported to a roll forming and shearing plant illustrated in FIG. 14 by a suitable means such as the truck represented at 130.

In accordance with one aspect of the invention, the bottom surface of the subpanel 12 of the panel 10 may be coated with a liquid coating coating material which when cured sublimates at a temperature blow the temperature at which the foam material 15 is excessively damaged in order to improve the fire rating of the panel. This sublimating material is not illustrated in FIG. 4 because its thickness would approximate the thickness of paint and accordingly would not be seen in the scale of FIG. 4. However, the use this sublimating material is designated in FIG. 4 by the reference numeral 150. The sublimating material may be Thermo- Lag 220-1 or 220-WR, manufactured by TSI, Inc., St. Louis, Missouri, or other suitable material. The method for applying the sublimating coat to the panel 12, as well as the desired interface coating to provide a good bond between the subpanel 12 and the foam 15 is applied as illustrated in FIG. 12 with a conventional coil coating line. In this system, the coil steel 152 having a width required to ultimately form the corrugated subpanel 12 is passed through successive stations 153–159 to prepare the steel for coating. Then the sublimating coating is applied at station 160 followed by a foam interface back wash coating 161 on the opposite side of the coil. The steel web is then passed through a heating station 162 and a cooling station 163 to fix the applied coating before being wound on a coil 164. The coils 164 are then transported to roll forming and shearing plant as represented by truck 166.

After the coils 128 of metal laminated with Hypalon are taken to a roll forming and shearing plant where the flanges 16*a* and 16*b* are formed by conventional roll forming rollers represented at 170, then sheared to the appropriate length by shears 172. The resulting panels can be nested by appropriate curvature of the center section as represented at 174, packaged as represented at 176, and then transported as represented by the truck 178 to multiple panel assembly sites located at strategic points around the nation near the ultimate erection sites. Similarly, the coils 164 may be passed through corrugation and edge rollers 180 and shears 182 to provide a stack 104 of corrugated and edge-rolled panels 12. The panels 184 can then be crated as represented at 186 and transported as represented by the truck 188 to the various panel assembly sites. At the fabrication sites, the panels are placed in parallel positions, the Z-shaped members 30 and 32 inserted in the rolled edges 12*a* and 12*b*, and the foam material 15 injected between the panels and cured in the conventional manner. The staples 34 are then inserted using a conventional staple gun. These steps are represented by station 190. The fastener devices 20–23 are then bonded along the edges of the panel as represented at station 192. The inserts 15*a* may be secured at either station 190 or 192, or may even be placed in position in the field after the installation of the self-tapping fasteners 52, as previously described. The panels are then stacked and crated as represented at 194, and transported to an erection site as represented by the truck 196.

At the erection site, the panels may be erected into a sloped roof as represented by 198, or in a flat roof system as represented by roof 200. It is also to be understood that the panels with only slight modifications can be used for both exterior and interior walls where a fluid-tight corrosion-resistant membrane is required, or where extreme differences in interior and exterior temperatures require the thermal expansion characteristics of the panel, even where other sealing means are utilized.

From the above detailed description of the preferred embodiments of the invention, it will be appreciated that a novel and highly useful prefabricated panel system for building applications has been described.

What is claimed is:

1. The prefabricated panel for a building system which comprises;

a rectangular lower sheet metal member having opposite side edges and opposite end edges, a rolled portion forming a side lip of multiple thickness along each side edge and an up-turned flange extending substantially the length of each side edge, each up-turned flange being inset from the outer edge of the side lip to provide an area of multiple thickness through which a self-tapping fastener may be passed to connect the lower sheet metal member to an underlying support structure;

a flat upper sheet metal member having down-turned flanges at each side edge thereof substantially aligned with the respective up-turned flanges of the lower sheet metal member and extending substantially the length of the upper sheet metal member, the edges of the down-turned flanges being spaced from the edges of the up-turned flanges;

a body of insulating material filling the space between the sheet metal members and between the up-turned and down-turned flanges;

the upper sheet metal member and the body of insulating material terminating short of one end of the lower sheet metal member such that the lower sheet metal member protrudes to form an end lip; and a plurality of U-shaped staples disposed at spaced intervals along each side of the panel, each staple having points penetrating the respective aligned up-turned and down-turned flanges for establishing a tension connection between the upper sheet metal member and the lower sheet metal member while permitting substantially independent thermal expansion and contraction of the lower and upper sheet metal members in both directions of the plane of the respective members, the staples including barb means on the points for retaining the points in the respective flanges.

2. The prefabricated panel for a building system which comprises;

a rectangular lower sheet metal member having opposite side edges and opposite end edges, and stiffening corrugations extending between the end edges, a rolled portion forming a side lip of multiple thickness along each side edge and an up-turned flange extending substantially the length of each side edge, each up-turned flange being inset from the outer edge of the side lip to provide an area of multiple thickness through which a self-tapping fastener may be passed to connect the lower sheet metal member to an underlying support structure;

a flat upper sheet metal member having down-turned flanges at each side edge thereof substantially aligned with the respective up-turned flanges of the lower sheet metal member and extending substantially the length of the upper sheet metal member, the edges of the down-turned flanges being spaced from the edges of the up-turned flanges; and a body of insulating material filling the space between the sheet metal members and between the up-turned and down-turned flanges;

the upper sheet metal member and the body of insulating material terminating short of one end of the lower sheet metal member such that the lower sheet metal member protrudes to form a corrugated end lip.

* * * * *